US006783722B2

(12) United States Patent
Taylor

(10) Patent No.: US 6,783,722 B2
(45) Date of Patent: Aug. 31, 2004

(54) APPARATUS AND METHOD FOR PRODUCING A NONWOVEN WEB OF FILAMENTS

(75) Inventor: Thomas B. Taylor, Greer, SC (US)

(73) Assignee: BBA Nonwovens Simpsonville, Inc., Simpsonville, SC (US)

( * ) Notice: Subject to any disclaimer, the term of this patent is extended or adjusted under 35 U.S.C. 154(b) by 231 days.

(21) Appl. No.: 10/219,134

(22) Filed: Aug. 15, 2002

(65) Prior Publication Data

US 2003/0057586 A1 Mar. 27, 2003

Related U.S. Application Data

(60) Provisional application No. 60/325,056, filed on Sep. 26, 2001.

(51) Int. Cl.[7] ..... D04J 3/00

(52) U.S. Cl. ..... 264/465; 264/103; 264/555; 425/72.2; 425/174.8 R; 425/174.8 E; 425/66

(58) Field of Search ..... 425/72.2, 174.8 R, 425/174.8 E, 66, 382.2, DIG. 17; 264/103, 465, 555

(56) References Cited

U.S. PATENT DOCUMENTS

| | | | | |
|---|---|---|---|---|
| 3,302,237 A | | 2/1967 | Cope et al. | 226/91 |
| 3,325,906 A | | 6/1967 | Franke | 226/7 |
| 3,334,161 A | | 8/1967 | Guzman | 226/7 |
| 3,773,483 A | | 11/1973 | Schmidt | 65/478 |
| 3,777,231 A | * | 12/1973 | Guschin | 361/213 |
| 3,836,346 A | | 9/1974 | Stalego | 65/525 |
| 3,945,815 A | * | 3/1976 | Schmidt | 65/533 |
| 4,001,357 A | | 1/1977 | Walz et al. | 264/12 |
| 4,009,508 A | | 3/1977 | Sternberg | 19/155 |
| 4,692,106 A | | 9/1987 | Grabowski et al. | 425/66 |
| 4,812,112 A | | 3/1989 | Balk | 425/66 |
| 4,813,864 A | | 3/1989 | Balk | 425/66 |
| 4,820,142 A | | 4/1989 | Balk | 348/97 |
| 4,820,459 A | | 4/1989 | Reifenhauser | 264/403 |
| 4,838,774 A | | 6/1989 | Balk | 425/66 |
| 4,851,179 A | | 7/1989 | Reifenhauser | 264/555 |
| 4,961,695 A | | 10/1990 | Hirschmann et al. | 425/72.2 |
| 5,032,329 A | | 7/1991 | Reifenhauser | 264/40.5 |
| 5,211,903 A | | 5/1993 | Reifenhauser | 264/555 |

(List continued on next page.)

FOREIGN PATENT DOCUMENTS

| | | |
|---|---|---|
| FR | 2 815 647 A | 4/2002 |
| JP | 60 094664 A | 5/1985 |
| WO | WO 00/65133 A2 | 11/2000 |
| WO | WO 00/65134 A1 | 11/2000 |

*Primary Examiner*—Robert Davis
*Assistant Examiner*—Joseph S Del Sole
(74) *Attorney, Agent, or Firm*—Alston & Bird LLP

(57) ABSTRACT

Spunbond nonwoven fabrics are produced with an apparatus which comprises a spinnerette having a plurality of orifices for extruding filaments; an attenuator for receiving and attenuating the filaments; and a collection surface upon which the filaments are deposited to form a nonwoven web. A filament diffuser is positioned between the attenuator and the collection surface in the path of filament travel. The diffuser comprises a pair of opposing divergingly arranged side walls and a pair of opposing end walls, these walls collectively defining filament passageway. In accordance with one embodiment of the invention, a flow of fluid is injected along the walls of the diffuser in the direction of filament travel. More particularly, fluid is injected along both the opposing divergingly arranged walls and the opposing ends walls which form the diffuser. In another aspect of the present invention, the filaments are electrostatically charged and a like electrical charge is imparted to the walls of the diffuser. By independently controlling the electrical potential applied to the respective walls of the diffuser, the path of travel of the filaments through the diffuser can be affected in ways which improve the filament distribution and web formation.

33 Claims, 4 Drawing Sheets

U.S. PATENT DOCUMENTS 5,248,247 A 9/1993 Rubhausen et al. ..... 425/66
5,292,239 A 3/1994 Zeldin et al. ..... 425/66
5,336,071 A 8/1994 Kobayashi et al. ..... 425/66
5,397,413 A 3/1995 Trimble et al. ..... 156/167
5,439,364 A 8/1995 Gerkinge et al. ..... 425/66
5,460,500 A 10/1995 Geus et al. ..... 425/66
5,571,537 A 11/1996 Geus et al. ..... 425/72.2
5,643,524 A * 7/1997 Gilbert De Cauwer et al. ..... 264/441
5,648,041 A 7/1997 Rodgers et al. ..... 425/555
5,702,730 A 12/1997 Reifenhauser et al. ..... 425/72.2
5,714,171 A 2/1998 Profe ..... 425/66
5,766,646 A 6/1998 Geus et al. ..... 425/72.2
5,863,565 A 1/1999 Rossillon et al. ..... 425/72.2

* cited by examiner

APPARATUS AND METHOD FOR PRODUCING A NONWOVEN WEB OF FILAMENTS

CROSS-REFERENCE TO RELATED APPLICATION

This application claims priority from U.S. Provisional Patent Application No. 60/325,056 filed Sep. 26, 2001.

FIELD OF THE INVENTION

This invention relates to the manufacture of nonwoven fabrics, and more particularly to improvements in the manufacture of a spunbonded nonwoven web formed of substantially continuous filaments.

BACKGROUND OF THE INVENTION

In the manufacture of nonwoven webs by the well-known "spunbond" process, continuous filaments of a molten polymer are extruded from a large number of orifices formed in a spinnerette plate, the filaments are stretched or drawn, and are then randomly deposited upon a collection surface to form a nonwoven web. The stretching or attenuation can be mechanically through the use of draw rolls, or, as is more widely practiced, pneumatically by passing the filaments through a pneumatic attenuator.

Manufacturers of spunbonded nonwoven fabrics have long sought to improve the manufacturing process to achieve higher productivity and better quality and uniformity of the spunbonded nonwoven fabric. Maintaining the quality and uniformity of the fabric becomes a particular concern at higher production speeds and when producing fabrics of low basis weight. Several characteristics affect the quality and uniformity of spunbonded nonwoven fabrics.

Filament separation is the degree of separation of the individual filaments from one another. Good filament separation occurs when the filaments are randomly arranged with limited parallel contact between the filaments. Ideally, no individual filaments should be in parallel contact with another filament, although, in practice, filaments tend to be in parallel contact over considerable distances. Good filament separation is particularly important for lightweight fabrics, where good coverage is more difficult to achieve. Ropiness is the extreme state of poor filament separation. Large numbers of filaments in parallel twisted contact result in long strands in the fabric, which can causes holes or very thin areas in the fabric. Splotchiness is a relative large-scale non-uniformity in basis weight. A fabric having splotchiness is generally weak because of the lower tensile strength of the thin areas of the fabric. Also, a splotchy fabric generally has poor cover properties.

Many attempts have been made to address the problems of poor filament separation, ropiness and splotchiness while still preserving the tensile properties of nonwoven webs made from spunbond thermoplastic filaments. For example, U.S. Pat. Nos. 3,296,678; 3,485,428 and 4,163,305 describe various apparatus and methods for mechanical and pneumatic oscillation of continuous filament bundles to spread the filaments as they are deposited on the collection surface. U.S. Pat. No. 4,334,340 describes using an airfoil at the exit of a round attenuator tube to separate continuous filaments prior to their deposit on a forming wire. Forced air follows the leading edge of the air foil and filaments striking the foil are carried by the forced air onto a forming wire, resulting in a spreading of the filament bundle that promotes random deposit of the filaments.

Various electrostatic methods have been proposed to promote spreading of the filament bundle by applying an electric charge to the filaments to cause the filaments to repel one another. U.S. Pat. Nos. 3,338,992 and 3,296,678 describe electrostatically charging the filament bundle with an ion gun or corona discharge device prior to drawing and forwarding the filaments. U.S. Pat. No. 5,397,413 describes a process for producing spunbond nonwoven fabrics wherein the filaments are attenuated with a slot shaped pneumatic attenuator and wherein the filaments are electrostatically charged to enhance filaments separation.

A number of spunbond manufacturing processes employ a diffusion chamber located between the pneumatic attenuator and the collection surface to assist in controlling the airflow and thereby achieving improved formation. For example, devices of this general type are shown in the apparatuses described in U.S. Pat. Nos. 3,334,161; 4,812,112; 5,211,903; 5,439,364; 5,814,349, and in published applications WO 00/65133 and WO 00/65134.

While the known apparatus and processes are satisfactory in many respects, it is still recognized that the formation of a spunbond fabric is not as uniform and consistent as is desirable, and that the need exists to continue to improve the uniformity of a spunbond nonwoven fabric.

Accordingly, it an object of the present invention to provide improvements in the manufacture of spunbond nonwoven fabrics, and in particular to provide for improved formation of the filaments into a spunbond nonwoven fabric with enhanced uniformity.

SUMMARY OF THE INVENTION

In accordance with the present invention, it has been discovered that the aerodynamic behavior of the airflow in a region just above where the filaments are deposited on the collection surface chamber plays an important role on the uniformity of formation of the fabric. In accordance with the invention, a filament diffuser is positioned between the attenuator and the collection surface in the path of filament travel. The diffuser comprises a pair of opposing divergingly arranged side walls and a pair of opposing end walls, these walls collectively defining filament passageway. In accordance with one embodiment of the invention, it has been found that the formation can be significantly improved by injecting a flow of fluid along the walls of the diffuser in the direction of filament travel. More particularly, fluid is injected along both the opposing divergingly arranged walls and the opposing ends walls which form the diffuser.

In another aspect of the present invention, it has been found that the formation can be further improved by electrostatically guiding the filaments. This is achieved by electrostatically charging the filaments and also imparting a like electrical charge to the walls of the diffuser. By independently controlling the electrical potential applied to the respective walls of the diffuser, the path of travel of the filaments through the diffuser can be affected in ways which improve the filament distribution and web formation.

Thus, in accordance with one aspect of the present invention, an apparatus for producing nonwoven fabrics is provided which includes a spinnerette having a plurality of orifices for extruding filaments, an attenuator for receiving and attenuating the filaments, and a collection surface upon which the filaments are deposited to form a nonwoven web. A filament diffuser is positioned between the attenuator and the collection surface in the path of filament travel. The diffuser comprises a pair of opposing divergingly arranged side walls and a pair of opposing end walls, these walls collectively defining filament passageway. At least one fluid injection port is provided in the side walls oriented for injecting a flow of fluid along the side walls in the direction of filament travel. At least one fluid injection port is also provided in the end walls oriented for injecting a flow of fluid along the end walls in the direction of filament travel.

According to another aspect of the invention, an apparatus for producing nonwoven fabrics is provided which includes a spinnerette having a plurality of orifices for extruding filaments, an attenuator for receiving and attenuating the filaments; and a collection surface upon which the filaments are deposited to form a nonwoven web. A filament diffuser is positioned between the attenuator and the collection surface in the path of filament travel. The diffuser comprises a pair of opposing divergingly arranged side walls and a pair of opposing end walls defining a filament passageway. A corona device is provided cooperating with the filaments for imparting an electrical charge on the filaments, and means is provided for imparting a like electrical charge on at least one of the side walls of said filament diffuser so as to thereby guide the filaments as they pass through the diffuser. Preferably, the electrical charge is imparted on at least one of the side walls of filament diffuser by a first power supply electrically connected to one of said the walls and a second power supply electrically connected to the other of said the walls. The first and second power supplies are independently controllable for applying a variable electrical potential to the respective side walls for thereby electrostatically guiding the filaments as they pass through the filament diffuser.

BRIEF DESCRIPTION OF THE DRAWINGS

Some of the features and advantages of the present invention having been stated, others will appear as the description proceeds, when taken in connection with the accompanying drawings, in which.

DESCRIPTION OF THE ILLUSTRATED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
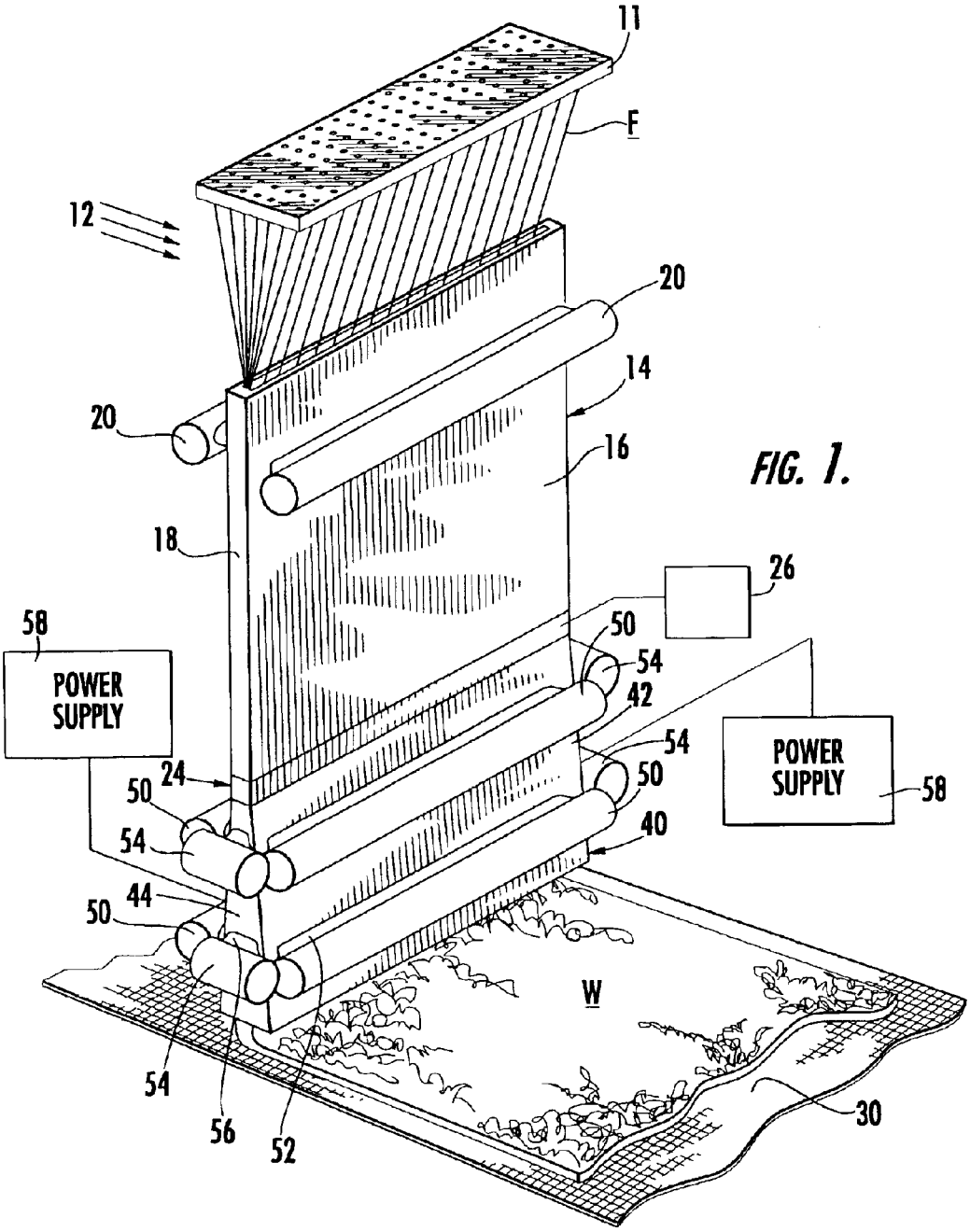
FIG. 1 is a schematic front prospective view showing an apparatus for producing a spunbond nonwoven fabric in accordance with the invention.

FIG. 1 schematically illustrates a portion of an apparatus for producing a spunbond nonwoven web of continuous filaments. Continuous filament F of a thermoplastic polymer are produced by extruding molten thermoplastic polymer through orifices in a spinnerette plate 11 which forms part of a spin block assembly. The molten thermoplastic polymer is supplied to the spin block assembly from an extruder. Suitable equipment for this purpose is commercially available from various sources. The spunbond process is applicable to a variety of thermoplastic polymers, copolymers and mixtures thereof, and it will be understood that the present invention is not restricted to any specific polymer compositions. As the molten polymer is extruded from the spinnerette 11 to form filaments, cooling air 12 is directed into contact with the filaments to quench and solidify the molten polymer. The filaments enter the open upper end of a slot draw attenuator 14. The slot draw attenuator 14 is defined by a pair of opposing side walls 16. In the embodiment shown, opposite ends of the attenuator are closed by end walls 18. Pressurized air supplied by a fan or blower, not shown, is directed into manifolds 20 which extend alongside the outer surfaces of the side walls 16 across substantially the fill widthwise extent of the wall. Air from the manifold is directed via a duct and is injected into the attenuator in the direction of filament travel through openings provided in the attenuator walls 16. The downward flow of air through the attenuator 14 causes acceleration of the filaments and results in attenuation or drawing of the filaments. In the embodiment shown, the acceleration and attenuation of the filaments results from the injection of air into the attenuator. However, those skilled in the art recognize that the present invention is not limited to the particular type of attenuation shown in the drawings and that other well-known types of mechanical or pneumatic attenuators could be utilized.

A corona device, generally indicated by reference character 24, is located adjacent the exit end of the attenuator. The corona device generates a corona of ionized air through the filaments F pass, which introduces an electrostatic charge on the filaments, causing the filaments to repel one another. The attenuator device is connected to a high voltage power supply 26. The corona device more particularly includes a corona electrode assembly 27 that is carried by one attenuator side wall and extends the full width of the wall in the cross machine direction. The electrode assembly is connected to the high voltage power source 26. Located opposite the electrode assembly and carried by the opposite attenuator wall is a ground plate 28 which is electrically grounded. The corona device is described in greater detail in U.S. Pat. No. 5,397,413, which is incorporated herein by reference.

After the filaments emerge from the discharge end of the attenuator 14, they continue to travel downwardly and are randomly deposited on a collection surface to form a nonwoven web W. More particularly, in the embodiment shown the collection surface is an endless moving open mesh belt 30, shown more clearly in FIG. 2.

Located between the lower end of the attenuator 16 and the upper surface of the belt is a diffuser chamber generally indicated at 40. The diffuser 40 is defined by a pair of opposing side walls 42 and end walls 44. The side walls have a width dimension corresponding substantially to the width of the belt and thus extend generally in the cross machine direction across the belt. The walls 42 are arranged at an angle to one another diverging in the direction of filament travel. Thus, the side walls 42 and end walls 44 define a filament passageway with a relatively narrow slot shaped open upper end positioned for receiving the filaments from the attenuator and with an open lower end of larger cross sectional area positioned just above the collection belt 30. The increasing cross sectional area of the diffuser chamber in the direction of filament travel allows for deceleration of the air in the diffuser chamber.

Figure 2:
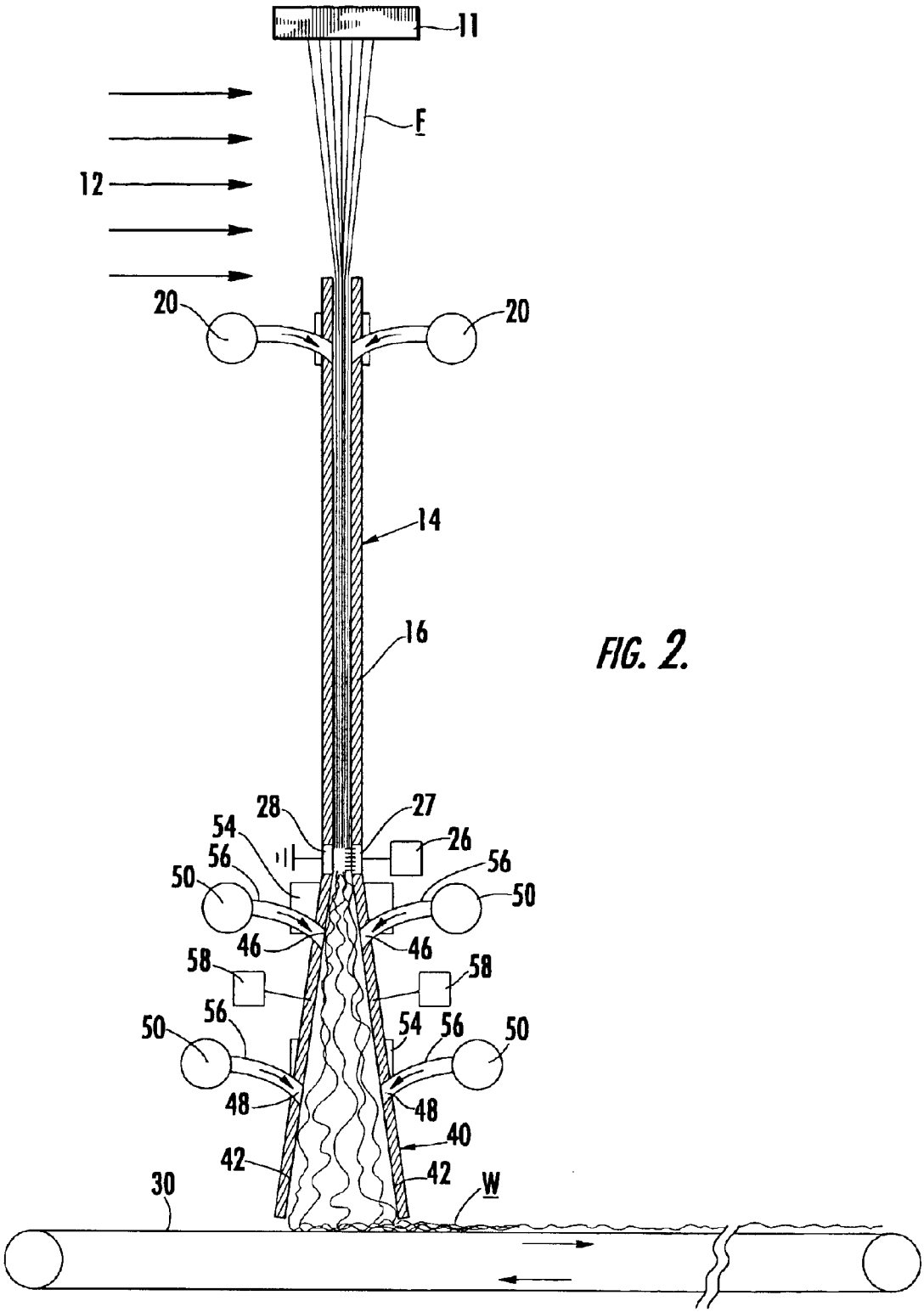
FIG. 2 is a schematic side cross sectional view of the apparatus.

In accordance with the present invention, it has been determined that the aerodynamic conditions with in the diffuser chamber play an important role in achieving good web formation. Moreover, periodic eddy currents or other transient variations in aerodynamic conditions cause transient variations in the arrangement or distribution of the filaments as they approach the collection belt. Once the filaments are laid down on the collection belt, this transient variation in filament distribution is "frozen" into the web and will be evident as variations in the web formation, such as blotches or thick or thin areas in the web. Therefore, to eliminate such transient disturbances, a fluid, preferably air, is injected into the diffuser chamber along the walls of the diffuser chamber in the direction of filament travel. The injection of air along the walls alters the air velocity profile within the diffuser chamber, and in so doing, eliminates or reduces transient variations in aerodynamic conditions. As seen in FIG. 2, air is injected into the diffuser through elongate slits formed in each side wall 42. Pressurized air is supplied to the slit. The slit is formed so as to introduce the air into the diffuser chamber downwardly in the direction of filament travel and generally parallel to the inner surfaces of the side walls 42.

In the embodiment shown in FIG. 2, air is injected into the diffuser 40 at more than one location along the height dimension of the side wall 42. Each side wall includes an upper elongate slit 46 located adjacent the upper end of the side wall 42 and a lower slit 48 downstream in the direction of filament travel from the upper slit. Each slit extends substantially entirely across the widthwise extent of the side wall 42. A manifold 50 is located adjacent the outer surface of the side wall 42 alongside each slit and a supply duct 52 connects each manifold 50 to its respective slit 46, 48. Each manifold 50 is supplied with pressurized air from a blower, not shown, or other suitable source. The flow of air to each manifold 50 can be independently controlled by suitable valves, not shown, so that the aerodynamic conditions within the diffuser chamber can be precisely controlled.

Air is also injected into the diffuser 40 along each end wall 44. Each end wall has upper and lower slits therein at locations along the height dimension of the end wall generally corresponding to the locations of the slits 46, 48 in the side walls 42. A manifold 54 and associated supply duct 56 provides a flow of pressurized air through each slit in the end wall 44. Like the slits 46, 48 in the end walls, the slits are oriented so as to introduce air along the interior surface of the end wall downwardly in the direction of filament travel. In addition to eliminating or minimizing transient variations in aerodynamic conditions, the introduction of air along the end walls 44 also provides effective control over the width of the formed web. If the introduction of air along the end walls 44 is eliminated or significantly reduced, the filaments tend to stay away from the end walls 44 and thus fill less than the entire width of the attenuator slot. As a result, a web of reduced width is formed. In addition, the filaments are more concentrated in the central portion of the web and the web density or weight along opposite edges may be lower than in the central portion. By injecting a controlled flow of air along the end walls 44, the filaments can be caused to more uniformly fill the full width of the attenuator slot and formation along the opposite edges of the web is improved. The injection of air along the end walls is controlled independently of the air injected along the side walls for precise control of formation along the full width of the web W.

To obtain further control over the filament distribution within the diffuser 40, an electrostatic charge is applied to the diffuser side walls 42. More specifically, each wall is electrically connected to a respective power supply 58 which supplies a high voltage electrical potential to the respective side walls 42. Each power supply can be independently controlled. The polarity of the electrical potential matches the polarity of the charge on the filaments imparted by the corona electrode assembly 27. Since like electrical charges repel, the electrostatic potential on the side walls 42 causes the filaments to be repelled from the side walls. By independently controlling the electrical potential on each wall, the filaments can be repelled more from one side wall 42 than from the opposite wall. The filaments can thus be electrostatically guided or "steered" within the diffuser chamber 40 in a manner analogous to the way that a beam of electrons in a television picture tube is deflected by a deflection coil associated with the picture tube.

Figure 4:
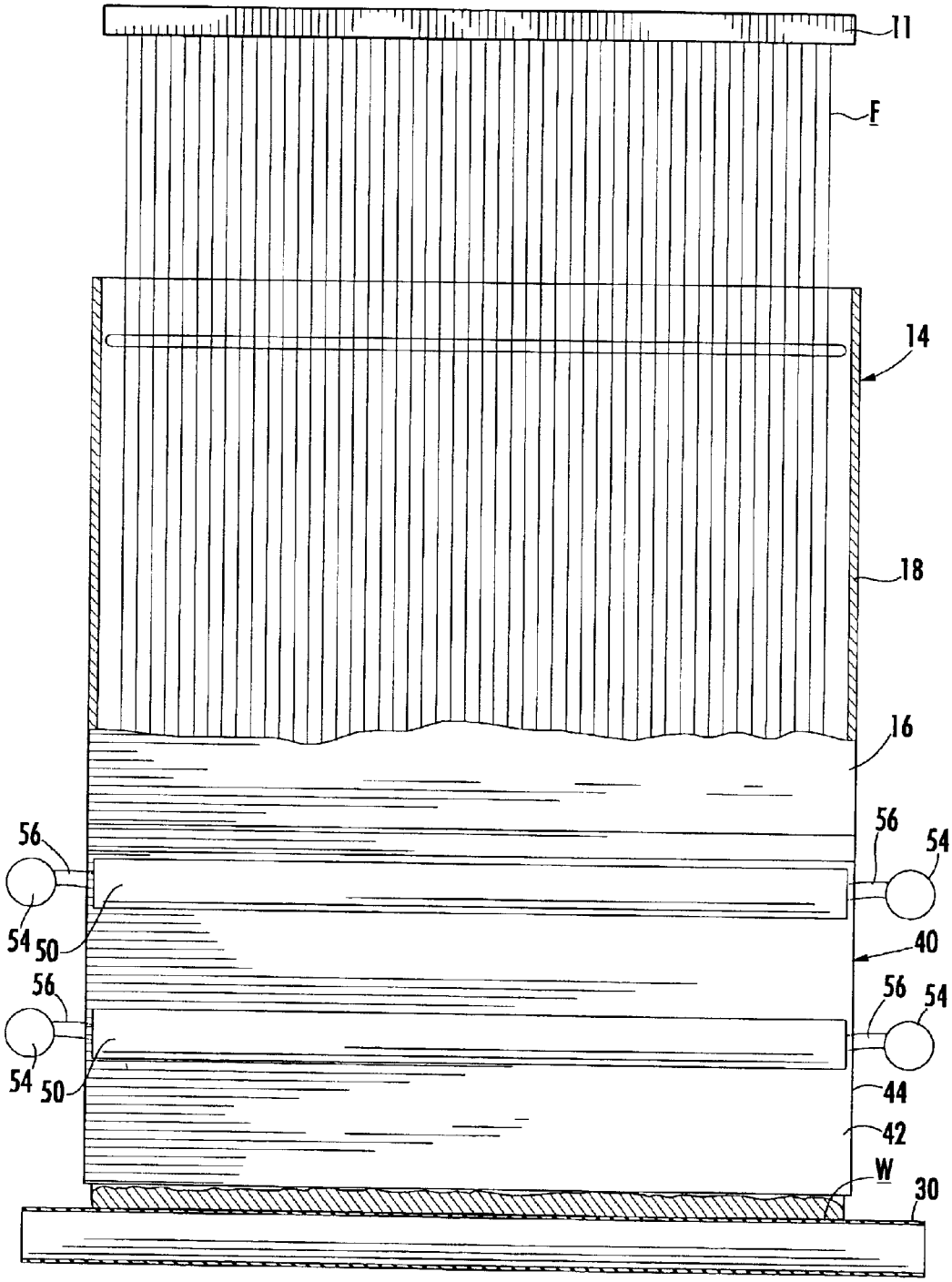
FIG. 4 is an end view of the apparatus, with portions broken away.

FIG. 4 is an end view of the apparatus schematically illustrating the path of travel of the filaments from the spinnerette plate 12 to the collection belt 30. Portions of the wall of the attenuator have been broken away for clarity of illustration.

Figure 3:
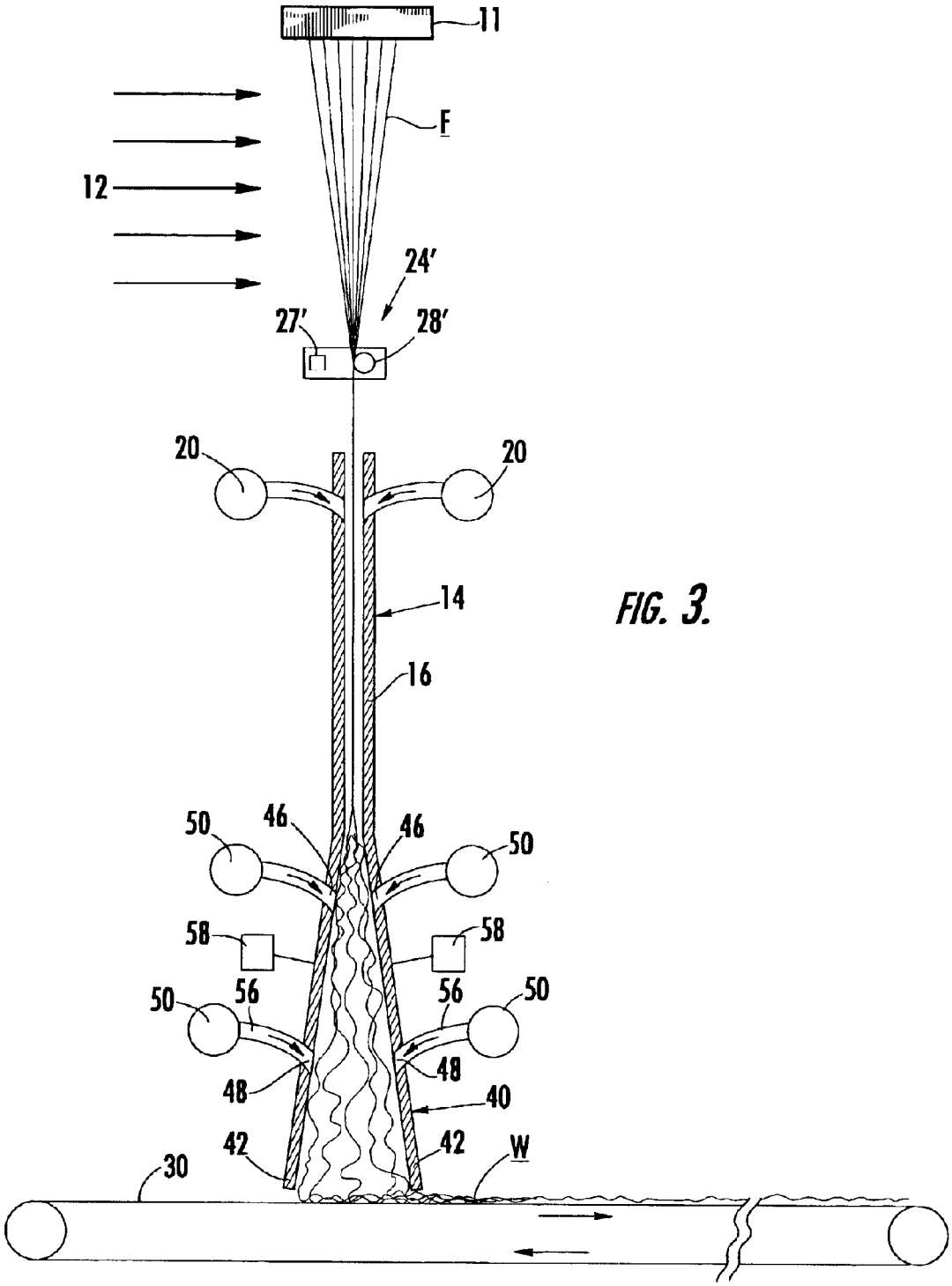
FIG. 3 is a side cross sectional view similar to FIG. 2 showing an alternative embodiment of the apparatus.

FIG. 3 illustrates an alternate embodiment of an apparatus in accordance with the present invention. Since most of the elements in this embodiment are substantially identical to those previously described in connection with FIGS. 1 and 2, these like elements are identified by the same reference characters to avoid repetitive description. Basically, the embodiment of FIG. 3 differs over that of FIG. 1 in that the corona device for electrostatically charging the filaments is located between the spinnerette plate 12 and the top of the attenuator 14, rather than between the bottom of the attenuator 14 and the diffuser 40 as in the previous embodiment. In this embodiment, the filaments travel past at least one corona device 24' including a corona electrode assembly 27' and a roll 28'.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for producing nonwoven fabrics comprising:

a spinnerette having a plurality of orifices for extruding filaments;

an attenuator for receiving and attenuating the filaments;

a collection surface upon which the filaments are deposited to form a nonwoven web; and a filament diffuser positioned between the attenuator and the collection surface in the path of filament travel, said diffuser comprising a pair of opposing divergingly arranged side walls and a pair of opposing end walls defining a filament passageway, at least one fluid injection port in said side walls oriented for injecting a flow of fluid along the side walls in the direction of filament travel, and at least one fluid injection port in said end walls oriented for injecting a flow of fluid along the end walls in the direction of filament travel.

2. An apparatus according to claim 1, wherein each of said side walls has an elongate slit defining said at least one fluid injection port, and an air manifold in fluid communication with said elongate slit, and including means for supplying air under pressure to said manifold.

3. An apparatus according to claim 2, wherein each of said end walls has an elongate slit defining said at least one fluid injection port, and an air manifold in fluid communication with said elongate slit, and including means for supplying air under pressure to said manifold.

4. An apparatus according to claim 1, wherein said collection surface comprises an endless belt having a width dimension and a length dimension, and wherein each of said side walls has a width dimension extending widthwise of said endless belt and a height dimension extending over substantially the entire distance between said attenuator and said collection surface, and wherein each of said side walls has an elongate slit extending along the width dimension of said wall and defining said at least one fluid injection port.

5. An apparatus according to claim 4, wherein each of said side walls includes a first elongate slit extending along the width dimension of said wall at a first location on said side wall and a second elongate slit extending along the width dimension of said wall at a second location downstream in the direction of filament travel from said first location.

6. An apparatus according to claim 5, wherein each of said end walls includes a first elongate slit extending along the width dimension of said wall at a first location on said end wall and a second elongate slit extending along the width dimension of said wall at a second location downstream in the direction of filament travel from said first location.

7. An apparatus according to claim 1 including means for imparting an electrical charge on the filaments that pass through the filament diffuser, and means for imparting an electrical charge on at least one of said side walls.

8. An apparatus according to claim 7, wherein said means for imparting an electrical charge on at least one of said side walls is operable for imparting the same polarity electrical charge as is imparted to the filaments so that the electrically charged filaments are electrostatically repelled from said at least one side wall.

9. An apparatus according to claim 7 wherein said means for imparting an electrical charge on the filaments is located between said attenuator and said filament diffuser.

10. An apparatus according to claim 7 wherein said means for imparting an electrical charge on the filaments is located between said attenuator and said spinnerette.

11. An apparatus according to claim 7, wherein said means for imparting a like electrical charge on at least one of said side walls of said filament diffuser comprises a first power supply electrically connected to one of said side walls and a second power supply electrically connected to the other of said side walls, said first and second power supplies being independently controllable for applying a variable electrical potential to the respective side walls for thereby electrostatically guiding the filaments as they pass through the filament diffuser.

12. An apparatus for producing nonwoven fabrics comprising:

a spinnerette having a plurality of orifices for extruding filaments;

an attenuator for receiving and attenuating the filaments;

a collection surface upon which the filaments are deposited to form a nonwoven web;

a filament diffuser positioned between the attenuator and the collection surface in the path of filament travel, said diffuser comprising a pair of opposing divergingly arranged side walls and a pair of opposing end walls defining a filament passageway;

a corona device cooperating with the filaments for imparting an electrical charge on the filaments, and means for imparting a like electrical charge on at least one of said side walls of said filament diffuser so as to thereby guide the filaments as they pass through the diffuser.

13. An apparatus according to claim 12 wherein said corona device is located between said attenuator and said filament diffuser.

14. An apparatus according to claim 12 wherein said corona device is located between said spinnerette and said attenuator.

15. An apparatus according to claim 12, wherein said means for imparting a like electrical charge on at least one of said side walls of said filament diffuser comprises a first power supply electrically connected to one of said side walls and a second power supply electrically connected to the other of said side walls, said first and second power supplies being independently controllable for applying a variable electrical potential to the respective side walls for thereby electrostatically guiding the filaments as they pass through the filament diffuser.

16. An apparatus for producing nonwoven fabrics comprising:

a spinnerette having a plurality of orifices for extruding filaments;

an slot-shaped pneumatic attenuator positioned beneath said spinnerette for receiving the filaments therefrom;

an endless collection belt beneath said attenuator upon which the filaments are deposited to form a nonwoven web;

a filament diffuser positioned between the attenuator and the collection surface in the path of filament travel, said diffuser comprising a pair of opposing divergingly arranged side walls each having a width dimension and a height dimension and a pair of opposing generally parallel solid end walls, each having a width dimension substantially less than that of said side walls and a height dimension substantially the same as that of said side walls, said side walls and end walls defining a filament passageway with a relatively narrow cross sectional area slot shaped open upper end positioned for receiving the filaments from said slot shaped attenuator and with a larger cross sectional area open lower end positioned above said collection belt for depositing the filaments thereon;

an elongate slit formed in each of said side walls and in each of said end walls extending in the width dimension of the respective walls and oriented for injecting a flow of fluid along the walls in the direction of filament travel; and means for supplying fluid under pressure to said slits.

17. An apparatus according to claim 16, including a second elongate slit formed in each of said side walls and in each of said end walls at a location beneath said first-mentioned slit, said second slit extending in the width dimension of the respective walls and being oriented for injecting a flow of fluid along the walls in the direction of filament travel.

18. An apparatus according to claim 16, wherein said means for supplying fluid to said slits includes a respective manifold communicatively connected to each slit, and an independently controlled source of air connected to each said manifold.

19. An apparatus for producing nonwoven fabrics comprising:

a spinnerette having a plurality of orifices for extruding filaments;

an slot-shaped pneumatic attenuator positioned beneath said spinnerette for receiving the filaments therefrom;

an endless collection belt beneath said attenuator upon which the filaments are deposited to form a nonwoven web;

a filament diffuser positioned between the attenuator and the collection surface in the path of filament travel, said diffuser comprising a pair of opposing divergingly arranged side walls each having a width dimension and a height dimension and a pair of opposing generally parallel solid end walls, each having a width dimension substantially less than that of said side walls and a height dimension substantially the same as that of said side walls, said side walls and end walls defining a filament passageway with a relatively narrow cross sectional area slot shaped open upper end positioned for receiving the filaments from said slot shaped attenuator and with a larger cross sectional area open lower end positioned above said collection belt for depositing the filaments thereon;

a corona device cooperating with the filaments for imparting an electrical charge on the filaments;

a first power supply electrically connected to one of said side walls and a second power supply electrically connected to the other of said side walls, said first and second power supplies being independently controllable for applying a variable electrical potential to the respective side walls for thereby electrostatically guiding the filaments as they pass through the filament diffuser.

20. An apparatus according to claim 19, including an elongate slit formed in each of said side walls and in each of said end walls extending in the width dimension of the respective walls and oriented for injecting a flow of fluid along the walls in the direction of filament travel.

21. An apparatus according to claim 20, including a second elongate slit formed in each of said side walls and in each of said end walls at a location beneath said first-mentioned slit, said second slit extending in the width dimension of the respective walls and being oriented for injecting a flow of fluid along the walls in the direction of filament travel.

22. An apparatus according to claim 21, wherein said means for supplying fluid to said slits includes a respective manifold communicatively connected to each slit, and an independently controlled source of air connected to each said manifold.

23. A method for producing nonwoven fabrics comprising:

extruding a plurality of filaments;

attenuating the filaments;

directing the filaments through a filament diffuser comprising a pair of opposing divergingly arranged side walls and a pair of opposing end walls defining a filament passageway, injecting a flow of fluid along the side walls in the direction of filament travel and injecting a flow of fluid along said end walls in the direction of filament travel;

discharging the filaments from the filament attenuator and depositing the filaments on a collection surface to form a nonwoven web.

24. A method according to claim 23 including imparting an electrical charge on the filaments that pass through the filament diffuser, and imparting a like electrical charge on at least one of said side walls.

25. A method according to claim 24 wherein the electrical charge is imparted on the filaments at a location between said attenuator and said filament diffuser.

26. A method according to claim 24 wherein the electrical charge is imparted on the filaments at a location above said attenuator.

27. A method according to claim 24, which includes applying a variable electrical potential to each of said side walls, and independently controlling the electrical potential applied to each of said side walls for thereby electrostatically guiding the filaments as they pass through the filament diffuser.

28. A method for producing nonwoven fabrics comprising:

extruding a plurality of filaments;

attenuating the filaments;

directing the filaments through a filament diffuser comprising a pair of opposing divergingly arranged side walls and a pair of opposing end walls defining a filament passageway, injecting a flow of fluid along the side walls in the direction of filament travel and injecting a flow of fluid along said end walls in the direction of filament travel;

discharging the filaments from the filament attenuator and depositing the filaments on a collection surface to form a nonwoven web.

imparting an electrical charge on the filaments, and imparting a like electrical charge on at least one of said side walls of said filament diffuser so as to thereby guide the filaments as they pass through the diffuser.

29. A method according to claim 28 wherein the electrical charge is imparted on the filaments at a location between said attenuator and said filament diffuser.

30. A method according to claim 28 wherein the electrical charge is imparted on the filaments at a location above said attenuator.

31. A method according to claim 28, which includes applying a variable electrical potential to each of said side walls, and independently controlling the electrical potential applied to each of said side walls for thereby electrostatically guiding the filaments as they pass through the filament diffuser.

32. A method according to claim 28, wherein the step of injecting a flow of fluid along the side walls comprises directing air into the diffuser and along each of the opposing the side walls thereof through an elongate slit formed in each respective side wall.

33. A method according to claim 32, wherein the step of injecting a flow of fluid along the end walls comprises directing air into the diffuser and along each of the opposing the end walls thereof through an elongate slit formed in each respective end wall.

* * * * *